US007429311B2

(12) United States Patent
Pietikäinen et al.

(10) Patent No.: US 7,429,311 B2
(45) Date of Patent: Sep. 30, 2008

(54) METHOD AND ASSEMBLY FOR MOISTENING A MOVING WEB OR PAPERBOARD

(75) Inventors: Reijo Pietikäinen, Järvenpää (FI); Henri Vaittinen, Järvenpää (FI); Heikki Kettunen, Espoo (FI); Markku Kojo, Espoo (FI)

(73) Assignee: Metso Paper, Inc., Helsinki (FI)

( * ) Notice: Subject to any disclaimer, the term of this patent is extended or adjusted under 35 U.S.C. 154(b) by 524 days.

(21) Appl. No.: 10/539,510

(22) PCT Filed: Jan. 8, 2004

(86) PCT No.: PCT/FI2004/000005

§ 371 (c)(1),
(2), (4) Date: Jun. 17, 2005

(87) PCT Pub. No.: WO2004/063463

PCT Pub. Date: Jul. 29, 2004

(65) Prior Publication Data

US 2006/0051516 A1 Mar. 9, 2006

(30) Foreign Application Priority Data

Jan. 9, 2003 (FI) ..... 20030031

(51) Int. Cl.

| | |
|---|---|
| ***D21G 1/00*** | (2006.01) |
| ***D21G 9/00*** | (2006.01) |
| ***B05B 1/24*** | (2006.01) |
| ***B05D 1/26*** | (2006.01) |

(52) U.S. Cl. ..... 162/207; 162/204; 162/375; 118/325; 118/718; 427/421.1

(58) Field of Classification Search ..... 162/204–207, 162/375, 198, 199, 252, 253, 263, 262, 289, 162/290, DIG. 6, DIG. 10, DIG. 11; 700/127–129; 427/421.1, 424; 118/300, 325, 718
See application file for complete search history.

(56) References Cited

U.S. PATENT DOCUMENTS

| | | | |
|---|---|---|---|
| 5,355,595 | A | 10/1994 | Koivukunnas et al. |
| 6,207,020 | B1 | 3/2001 | Anderson |
| 6,248,407 | B1 | 6/2001 | Hess |
| 6,309,463 | B1 | 10/2001 | Hess et al. |
| 6,962,296 | B2 * | 11/2005 | Hamel et al. ..... 239/11 |

FOREIGN PATENT DOCUMENTS

| | | | |
|---|---|---|---|
| DE | 29 25 026 | * | 1/1981 |
| DE | 101 16 840 A 1 | | 10/2002 |
| FI | 91301 | | 2/1994 |
| WO | WO 02/092908 A 1 | | 11/2002 |

* cited by examiner

*Primary Examiner*—Eric Hug
(74) *Attorney, Agent, or Firm*—Cohen Pontani Lieberman & Pavane LLP

(57) ABSTRACT

A method and assembly is disclosed for moistening a web of paper or paperboard, the assembly comprising a steam blow cavity open toward a moving web (1). The steam blow cavity houses spray nozzles (5, 6, 7) at least for injecting steam into the cavity so as to form a steam atmosphere therein. Additionally, the steam blow cavity houses spray nozzles (5, 6, 7) for spraying a mist of a heated liquid onto the web (1) within the thus formed steam atmosphere.

37 Claims, 2 Drawing Sheets

METHOD AND ASSEMBLY FOR MOISTENING A MOVING WEB OR PAPERBOARD

PRIORITY CLAIM

This is a national stage of PCT application No. PCT/FI2004/000005, filed on Jan. 8, 2004. Priority is claimed on Application No. 20030031, filed in Finland on Jan. 9, 2003.

BACKGROUND OF THE INVENTION

The present invention relates to a method and apparatus for moistening webs of paper and paperboard during the different steps of paper manufacture.

In the manufacture of paper or paperboard, the fibrous material of the web is worked in plural ways under the action of the manufacturing equipment. The most important force effects are: tension imposed on the web, the pressure and heat applied for water removal from the web, and the pressure, heat and moistening used in calendering. The different coating and sizing techniques also cause certain effects, particularly in conjunction with the use a doctor blade or bar. The working of individual fibers and the web formed therefrom in the manufacturing process determines the properties and quality of the end product. The working of fibers is especially strongly affected by the moisture content of the fibers. Another factor contributing to fiber deformation is the temperature of the fibers. In combination, these variables determine the threshold point at which the deformation of the fibers remains permanent. Thus, the web temperature and moisture content can be modified so that wide variations can be effected in the qualities of the end product. On the other hand, changes in the web moisture content or temperature cause changes in web properties, e.g., variations in the cross-machine moisture content profile of the web lead to web thickness variations. This relationship may even be put into active service by controlling the web moisture content profile or temperature profile so that variations in the web thickness profile are equalized.

Concurrently, moistening a paper web is generally carried out with the help of steam boxes and water mist sprays. In the steam box, steam is directed to the web surface from a steam blow cavity forming a closed space with the exception of a slit opening toward the web. The steam condensing on the surface of the dry paper web moistens and heats the paper web. However, the efficiency of steaming degrades abruptly as the surface temperature of the web rises above 60 to 80° C., whereby condensation becomes lesser. In multinip calendering, for instance, the web temperature rises heavily due to the effect of the heated rolls and intensive fiber working forces.

While water mist spraying permits application of large amounts of water to the web, the typically applied amount of water is only 1-4 g/m$^2$. As large water droplets spoil the web surface by causing defects such as mottling, water must be imported to the web surface in the form of finely atomized droplets. Conventionally, water is ejected from air-assisted nozzles capable of atomizing water into sufficiently small droplets. The water pumped to the nozzles is cold, and in practice the use of heated water is impossible, since the atomized water mist would cool down immediately after leaving the nozzle as atomized droplets. Nevertheless, heating the water to be atomized would theoretically be advantageous, particularly if large amounts of water need be applied. The use of hot water is, however, constrained by the rapid cooling is of the atomized water and evaporation thereof into the surrounding air of lower relative humidity. Due to these reasons, ejection of hot moistening water from conventional application nozzles is impossible.

SUMMARY OF THE INVENTION

It is an object of the invention to provide a method capable of ejecting against the surface of a paper or paperboard web atomized water heated to a temperature higher than the ambient temperature.

The invention is based on spraying the water onto the moving web in a closed box that opens toward the web and is filled with sufficiently saturated steam.

The invention offers significant benefits.

By virtue of the arrangement according to the invention, the web can be moistened and heated simultaneously even more effectively than what has been possible in the prior art. The heated water already itself imports heat to the web and, as saturated steam can be used as the atomization-assisting gas, also the impinging steam heats the web in the same fashion as in a steam-blowing system. Hot water has a lower viscosity and surface tension of hot water thus allowing better penetration of the hot water into the web. A particularly advantageous benefit of the invention is the facility of controlling web profile by an array of spray nozzles that makes it possible to control the web temperature and moisture content profiles simultaneously. In addition to the control of moistening water application, a new control facility is offered in the form of temperature control of the applied water. Generally, effective control of the web moisture content and temperature profiles on the dryer section of a paper or paperboard making machine is difficult and, as the web is very hot on this section, the moistening capability of steam boxes remains inferior due to the minimal condensation. On the other hand, application of cold water modifies the web temperature profile and such cooling of the web invokes a need for increased amount of evaporating energy. However, when the web is moistened using hot water, more energy is imported to the web and the efficiency of water application is good. Hence, the invention is well suited for controlling the qualities of a paper or paperboard web as well as the manufacturing process thereof on a dryer or calender section. The invention may be efficiently adapted to the relaxation of stresses in a paper or paperboard web by way of moistening therewith an overdried paper web or a paperboard.

The invention may be adapted to operate in conjunction with any type of steam box construction. The only essential requirement is that the water mist being sprayed cannot evaporate to the surrounding atmosphere or cool down prior to impinging on the web. Hence, the water spraying must take place in a space capable of supporting an atmosphere sufficiently saturated with steam, which in practice can be implemented in a closed box wherein the web being treated acts as one of the box walls. Steam boxes are described, e.g., in Pat. Nos. FI 91,301 and U.S. Pat. No. 6,207,020.

BRIEF DESCRIPTION OF THE DRAWINGS

In the following, the invention is examined with the help of the appended drawings, wherein.

DETAILED DESCRIPTION OF THE PRESENTLY PREFERRED EMBODIMENTS

In the following, a preferred embodiment of the steam box is described suitable for use in conjunction with the invention. More specifically, this steam box construction is described in co-pending Pat. Nos. FI 91,301 and U.S. Pat. No. 5,355,595.

The steam box may be located below a running paper web 1 or, alternatively, above the web as in FIG. 1. The steam box is surrounded by an enclosing structure 2 having the steam box components located therein. Steam is fed into the steam box via an infeed pipe 3, and the amount of steam injected onto web 1 is controlled by valves 5-7. The steam is blown against web 1 via a distribution grille 4. The valves 5-7 are arranged into groups of three valves. Each group includes three valves of different sizes, and each control segment along the cross-machine length of the steam box is provided with one such valve group. The use of differently sized valves gives a wide control range of applied steam quantity. The kinetic energy of the steam jet being blown against web 1 must be made so high that it doctors away the air boundary layer traveling with web 1 thus allowing the steam to heat the web. At low flow rates (2-20 kg/m/h), the steam flow velocity in a large-diameter valve remains so low that no steam can be blown to web 1. However, the use of a smaller valve allows the kinetic energy of steam flow to be made sufficiently high even at smaller flow rates.

Figure 1:
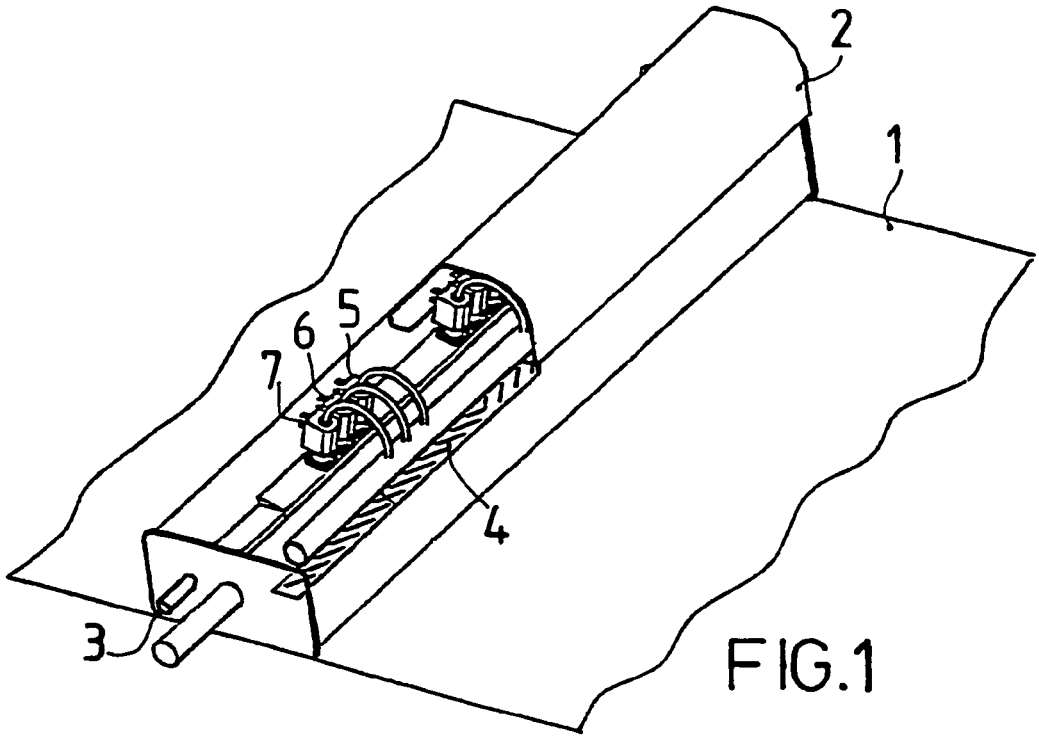
FIG. 1 is a diagrammatic view of an embodiment of a steam box according to the invention.
Figure 2:
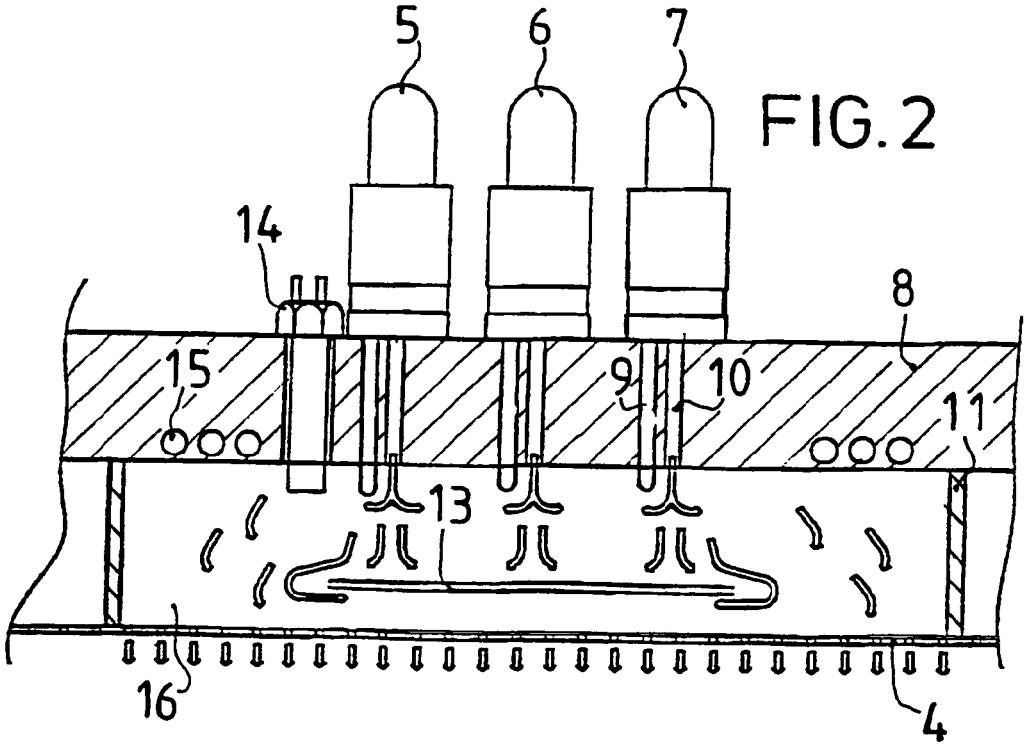
FIG. 2 is a partially sectional view of a detail of the steam box of FIG. 1.

In FIG. 2 is shown one control segment of the steam box of FIG. 1 in a cross-sectional view. Valves 5-7 are mounted on a support beam 8 along which steam blow ducts 10 are adapted to pass. The steam blow ducts 10 exit into a steam box 16 delimited by the support beam 8, partitions 11 and a drilled steam distribution grille. Opposite to the exit openings of steam blow ducts 10 and displaced at a distance therefrom is adapted a flow-equalizing baffle 13 whereon the steam jets ejected from the steam blow ducts 10 impinge. The flow-equalizing baffle 13 distributes the steam flow uniformly over the area of the control segment and simultaneously prevents large water droplets possibly still traveling along with the steam from reaching web 1.

Steam temperature in steam box 16 is monitored by a sensor 14. Support beam 8 further includes ducts 9 and 15.

Figure 3:
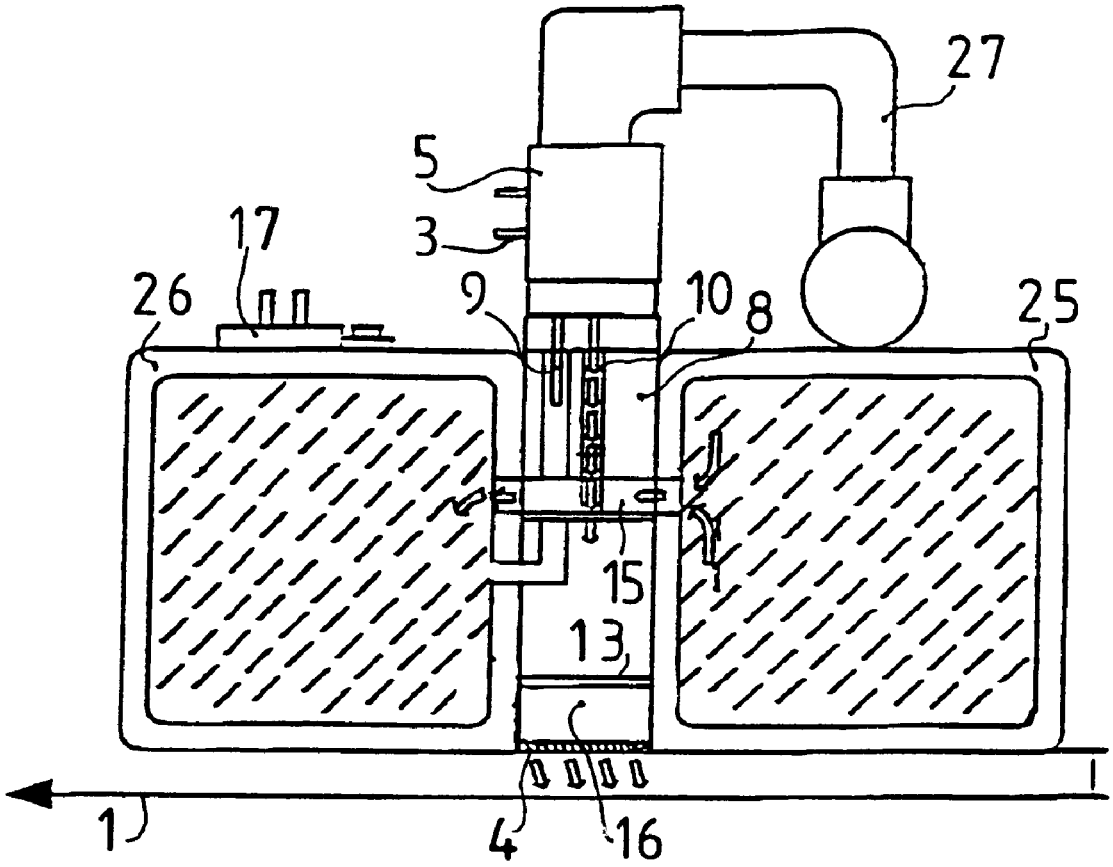
FIG. 3 is cross-sectional view corresponding to FIG. 2.

In FIG. 3 is shown an arrangement of the steam flow ducts in the steam box. To both sides of the steam blow cavity 16 of the box are adapted steam spaces 25 and 26. These spaces 25, 26 are joined by a communicating duct 15. To one steam space 25 is connected a steam infeed pipe 3. From the steam space 26 opposite thereto exits a steam inlet pipe 9 leading to valve 5, and to the upper part of valve 5 is connected a steam return pipe 27 via which the steam used for heating the valves is passed to a condensate return line. From valve 5 begins a steam blow duct 10 exiting into the steam blow cavity 16. When pressurized steam is fed via infeed pipe 3 into the first steam space 25, the space heats up. The steam flows further via the communicating duct to the second steam space 26 and also heats up this space. Thus, both sides of the steam blow cavity 16 and the walls facing web 1 have continuously heated surfaces that prevent condensation thereon and, moreover, the temperature of the steam blow cavity 16 is continuously kept essentially equal to the temperature of the steam spaces 25, 26.

When the above-described steam box construction is modified suitable for application of moistening water, it needs adaptation of water spray nozzles therein or, alternatively, the valves 5, 6, 7 must be replaced entirely or partially by water spray nozzles of a type capable of generating water mist using steam as the atomization-assisting gas. The steam atmosphere required in the system is partially created with the help of the atomization-assisting gas. Additionally, the structures of flow-equalizing baffle 13 and distribution grille 4 must be modified to accommodate a water infeed system. Inasmuch as web moistening and heating in this arrangement chiefly take place with the help of hot water, it is possible to contemplate total omission of the flow-equalizing baffle 13 and the distribution grille 4. An alternative possibility is to provide the flow-equalizing baffle 13 and the distribution grille with openings allowing the ejection of the water sprays therethrough. If the steam box is equipped with separate water-mist- spraying nozzles, e.g., of the high-pressure assisted type, the nozzles may be freely located in the steam blow cavity 16. The spacing between the nozzles and their spray pattern coverage must be adjusted such that a homogeneous coverage is obtained over the entire surface of the web.

The water to be sprayed via the nozzles is advantageously heated to a temperature of about 70-95° C. Heating the water to a higher temperature necessitates pressurization of the water infeed line and readily leads to the evaporation in the nozzle at the point of lower pressure and temperature thus making the heating of water to a high temperature generally disadvantageous. In fact, lower water temperatures can be utilized for the control of web temperature. To this end, the infeed water temperature should be controllable if technically possible. One possible way of controlling the water temperature is to use heated nozzles. Herein, the water is heated by an electric heater, for instance, and each nozzle is fed with water heated to the same temperature. In contrast, if the water temperature control is arranged to take place before the water enters the nozzles, a complicated heat exchanger and water supply system is needed for the infeed water.

Hot water is an efficient medium for heating the web, whereby the application of, e.g., 5 g/m$^2$ water heated to 90° C. on a web of 50 g/m$^2$ basis weight running at a temperature of 30° C. causes the averaged temperature of the web to rise by 10 to 15° C. The instantaneous rise of the web surface temperature is even higher. Additionally, the steam used as the atomizing gas in the water mist nozzles and the steam atmosphere of the steam blow cavity heat the web in the same fashion as a conventional steam box. In order to gain any benefit from heating the applied water, the water must be heated to a temperature above the web temperature. In certain cases it may be advantageous to control the web temperature profile down to a lower temperature by way of using water with a temperature below the web temperature. In the context of this invention, the term "heated water" refers to water having its temperature actively elevated from the normal temperature of the process water used at the plant prior to the application of the water to the moving web.

Figure 4:
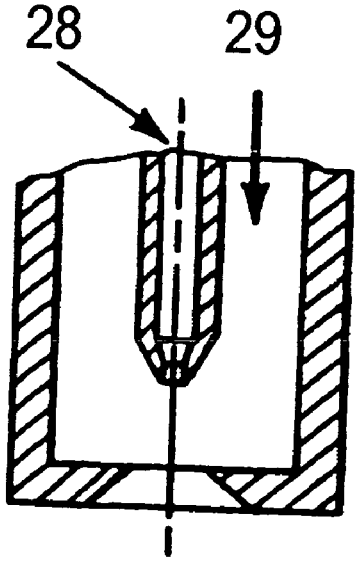
FIG. 4 is a cross-sectional view of a nozzle suitable for use in the steam box according to the invention.

In FIG. 4 is shown an embodiment of a spray nozzle suitable for use in the implementation of the present invention. The nozzle comprises a central nozzle body 28 for water injection enclosed by a sheath so that an annular channel 29 is formed for injection of an atomizing gas. In the present application, saturated steam is used as the atomizing gas in order to prevent the injected water from undergoing evaporative loss or evaporation into steam as it leaves the spray nozzle. Obviously, in lieu of the combination of water with saturated steam combination, also the application of other injectable media may be contemplated. Herein, the closest feasible alternatives include modification of injected water with additives affecting droplet formation/absorption or web qualities. Such additives are, e.g., detergents and viscosity reducers, antistatic additives and even dyes/pigments.

The invention may be applied in multiple ways in the manufacture of paper or paperboard. Possibly the most important application can be found in the moistening of a web being calendered inasmuch as particularly in calendering the outcome is strongly influenced by the web moisture content. Now, the present invention offers a powerful tool for controlling the moisture profile of the web and, given the good availability of versatile measurement equipment for sensing the web moisture content, the invention can efficiently utilize the measurement results in the improvement of product quality. While moistening the web on the press and dryer sections of a papermaking machine has conventionally been complicated, now more efficient moistening also on these sections becomes feasible owing to the easier penetration of hot water into the web. Moreover, the web temperature is not lowered by the application of hot water, but rather, the web temperature stays high even when subjected to moistening. As known, cross-machine control of drying effect on a dryer section is very difficult thus offering limited facilities of profile control on the dryer section. Now, the present invention offers substantial improvements in the efficiency of web profile control. For instance, the drying of certain paper grades at the final steps of web manufacture makes the web overdry, that is, so bonedry that it begins to absorb moisture from the surrounding atmosphere. As a result, the web develops internal stresses stemming from the earlier production steps and final drying. Now the invention makes it easy to moisten the web prior to upwinding so that the internal stresses are relaxed.

In addition to those described above, the invention may have alternative embodiments.

Spraying of water mist can be carried out using any type of spray nozzle capable of providing a spray pattern of desired shape and sufficiently small size of atomized droplets. Different kinds of nozzle structures are described in the literature of the art and nozzle manufacturers' product catalogs. The location of the nozzles in the steam blow cavity is determined by the blow cavity construction. Anyhow, the simplest arrangement is to replace conventional steam blow nozzles with dual-media injecting nozzles that can be mounted in lieu of existing steam blow nozzles. In principle, the steam box can be a hood opening toward the web, but this construction suffers from the condensation of steam on its unheated walls, whereby large water droplets can land on the moving web thus blemishing the surface of the web. The above-described steam box, however, is free from this problem. The atmosphere of the steam blow cavity of the steam box is advantageously kept filled with saturated steam in order to reduce the evaporation risk of water droplets to a minimum. If so desired, however, the moisture content and temperature of the steam atmosphere may be adjusted slightly lower. In lieu of water, also other liquid or furnish of liquid components may be sprayed onto the web, whereby obviously the atmosphere surrounding the furnish must be adjusted compatible with the liquid furnish to prevent evaporation of the liquid furnish. Depending on the type of the liquid furnish and the thermal effect desired from its application, the temperature of the liquid furnish may be in the range of 30-99° C.

What is claimed is:

1. A method for moistening a web of paper or paperboard comprising:

feeding steam into a steam blow cavity open toward the web to form a steam atmosphere;

applying a spray of liquid heated to a temperature higher than an ambient temperature from at least one nozzle onto the web in the steam atmosphere; and wherein the liquid is heated by a source separate from the steam.

2. The method of claim 1, wherein the temperature of the liquid applied as a spray is 70 to 95° C.

3. The method of claim 1, wherein the temperature of the liquid applied as a spray is 30 to 99° C.

4. The method of claim 1, wherein the step of feeding steam comprises injecting the steam from the same nozzle used to apply the heated liquid.

5. The method of claim 1, wherein the steam and the liquid required for establishing the steam atmosphere are injected from separate nozzles.

6. The method of claim 1, wherein an atmosphere of saturated steam is formed in the steam cavity.

7. The method of claim 1, wherein the steam is water vapor and the liquid is water.

8. The method of claim 1, wherein the temperature of the liquid being applied as a spray is controlled in a cross-machine direction.

9. The method of claim 1, wherein an amount of the liquid being applied as a spray is controlled in a cross-machine direction.

10. The method of claim 8, wherein the temperature or a flow rate of the liquid being applied as a spray is adjusted in a cross-machine direction with a control system that takes measurements of the web.

11. The method of claim 2, wherein the step of feeding steam comprises injecting the steam from the same nozzle used to apply the heated liquid.

12. The method of claim 3, wherein the step of feeding steam comprises injecting the steam from the same nozzle used to apply the heated liquid.

13. The method of claim 2, wherein the steam and the liquid required for establishing the steam atmosphere are injected from separate nozzles.

14. The method of claim 3, wherein the steam and the liquid required for establishing the steam atmosphere are injected from separate nozzles.

15. The method of claim 2, wherein an atmosphere of saturated steam is formed in the steam cavity.

16. The method of claim 3, wherein an atmosphere of saturated steam is formed in the steam cavity.

17. The method of claim 4, wherein an atmosphere of saturated steam is formed in the steam cavity.

18. The method of claim 5, wherein an atmosphere of saturated steam is formed in the steam cavity.

19. The method of claim 2, wherein the steam is water vapor and the liquid is water.

20. The method of claim 3, wherein the steam is water vapor and the liquid is water.

21. The method of claim 4, wherein the steam is water vapor and the liquid is water.

22. The method of claim 5, wherein the steam is water vapor and the liquid is water.

23. The method of claim 6, wherein the steam is water vapor and the liquid is water.

24. The method of claim 9, wherein the temperature or a flow rate of the liquid being applied as a spray is adjusted in a cross-machine direction with a control system that takes measurements of the web.

25. The method of claim 1, wherein the liquid is heated before entering the at least one nozzle.

26. The method of claim 1 further comprising controlling the temperature of the heated liquid.

27. The method of claim 26, wherein the step of controlling the temperature comprises heating the at least one nozzle.

28. An apparatus for moistening a web of paper or paperboard comprising:

a steam blow cavity that is open toward a moving web;

at least one nozzle for feeding at least steam into the steam blow cavity so as to form a steam atmosphere;

at least one nozzle for applying a spray of a liquid heated to a temperature higher than an ambient temperature onto the web in the steam atmosphere; and a heating device for heating the liquid using a source separate from the steam.

29. The apparatus of claim 28, wherein at least one of the nozzles is a dual-channel nozzle capable of injecting both steam and liquid.

30. The apparatus of claim 28, wherein separate nozzles are used for injecting the steam and the liquid.

31. The apparatus of claim 28, further comprising a means adapted to the nozzles for heating the steam or liquid ejected therefrom and for controlling the temperature of the steam or liquid ejected therefrom.

32. The apparatus of claim 28, wherein the apparatus is located in a dryer section, calender section or therebetween of a paper/paperboard manufacturing line.

33. The apparatus of claim 29, further comprising a means adapted to the nozzles for heating the steam or liquid ejected therefrom and for controlling the temperature of the steam or liquid ejected therefrom.

34. The apparatus of claim 30, further comprising a means adapted to the nozzles for heating the steam or liquid ejected therefrom and for controlling the temperature of the steam or liquid ejected therefrom.

35. The apparatus of claim 29, wherein the apparatus is located in a dryer section, calender section or therebetween of a paper/paperboard manufacturing line.

36. The apparatus of claim 30, wherein the apparatus is located in a dryer section, calender section or therebetween of a paper/paperboard manufacturing line.

37. The apparatus of claim 31, wherein the apparatus is located in a dryer section, calender section or therebetween of a paper/paperboard manufacturing line.

* * * * *